United States Patent [19]

Haga

[11] Patent Number: 4,753,009

[45] Date of Patent: Jun. 28, 1988

[54] MULTI-FUNCTION SEWING IMPLEMENT

[76] Inventor: Mary I. Haga, 20623 W. Lone Mountain, Wittmann, Ariz. 85361

[21] Appl. No.: 23,233

[22] Filed: Mar. 9, 1987

[51] Int. Cl.[4] ..... B26B 13/22

[52] U.S. Cl. ..... 30/123; 30/145; 30/146; 30/254

[58] Field of Search ..... 30/254–262, 30/118, 120, 145, 146, 315, 123

[56] References Cited

U.S. PATENT DOCUMENTS 1,552,688 9/1925 Filhtman ..... 30/254 X 2,573,652 11/1951 Bovee ..... 2/118 X 3,374,694 3/1968 Eizenberg ..... 30/254 X

*Primary Examiner*—Douglas D. Watts

*Attorney, Agent, or Firm*—Joseph Roediger; Gregory Nelson

[57] ABSTRACT

A multi-function sewing implement having a scissor configuration wherein one cutting edge is curved for raising and severing single stitches and the opposing cutting edge is straight. The adjacent edge member is provided with an extension containing a recess useful in the ripping of seams.

4 Claims, 1 Drawing Sheet

FIG. 1
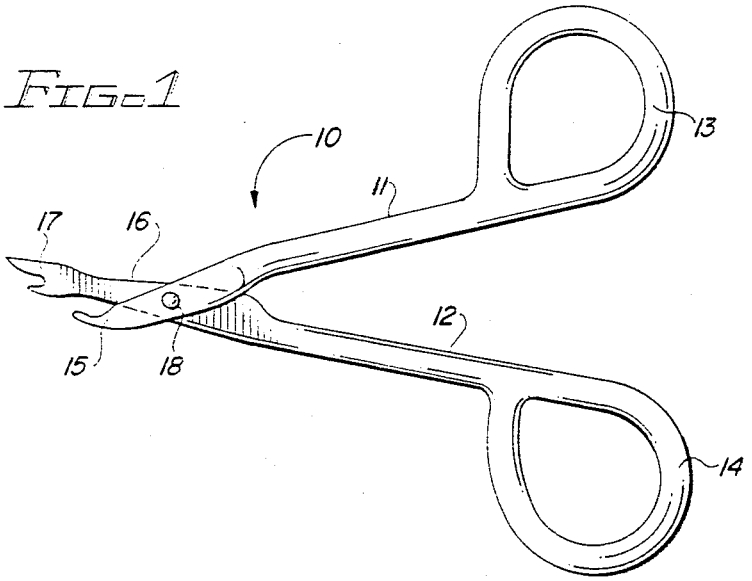
FIG. 4
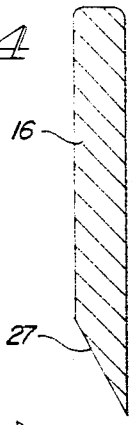
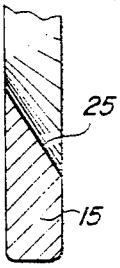
FIG. 5
FIG. 2
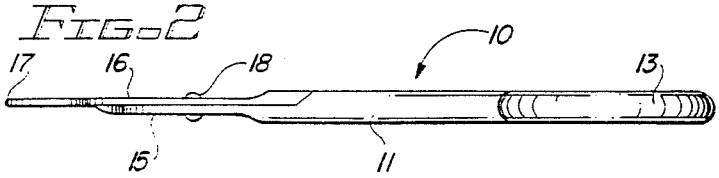
FIG. 3
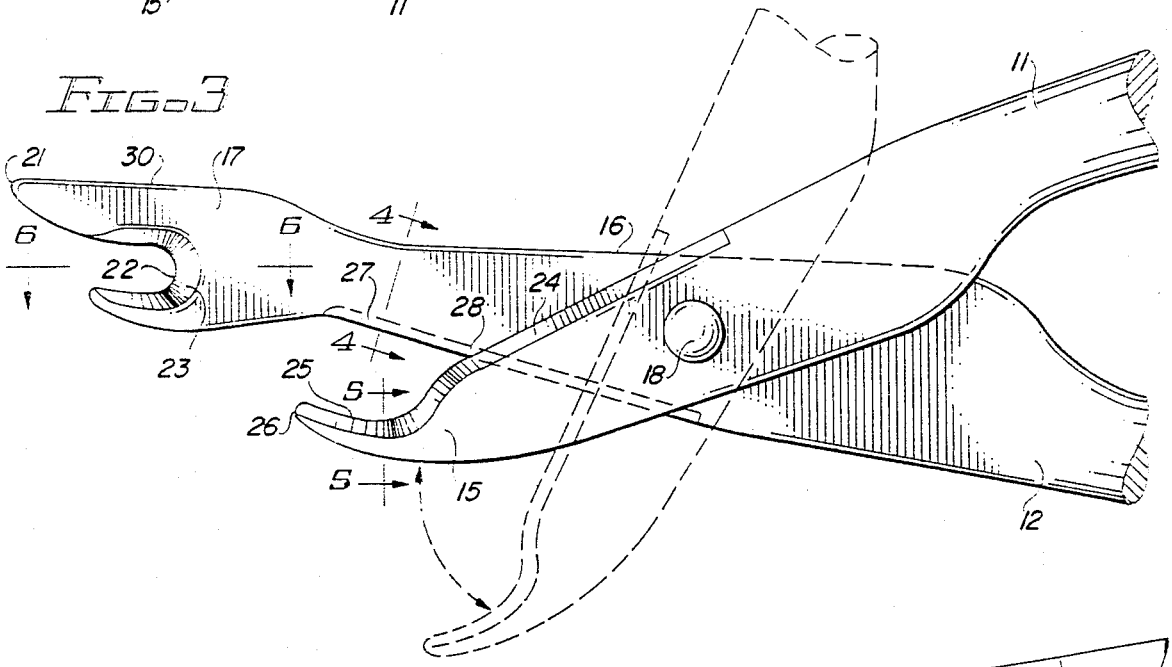
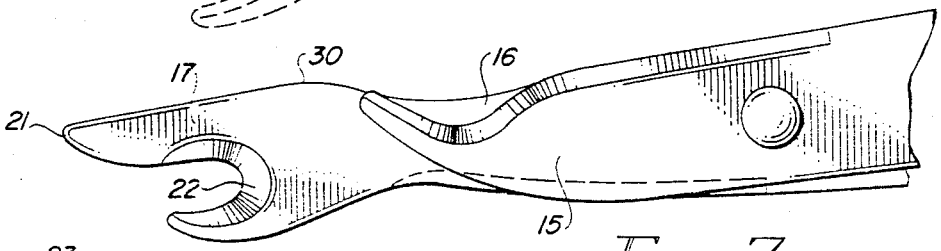
FIG. 7
FIG. 6
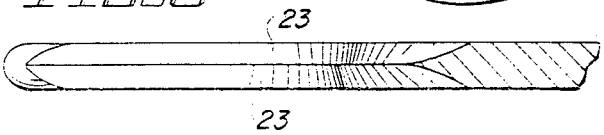

MULTI-FUNCTION SEWING IMPLEMENT

BACKGROUND OF THE INVENTION

This invention relates to multi-function sewing implements and, in particular, to scissors having cutting edges configured to facilitate the performance of multiple tasks encountered in sewing.

The conventional pair of scissor blades is characterized by two similar cutting edges formed on elongated members and adjacently positioned by a pivot means located in the shank portions of the members. The primary function of conventional scissors is the severing of material and, to that end, the cutting edges are typically coextensive so as to permit a substantial amount of material to be severed with a single operating stroke. In devices of this type but designed for use with materials other than fabric, the mechanical advantage is normally increased by extending the hand-grippable portion along with a corresponding decrease in the length of the cutting edges.

In addition to varying the relative lengths of adjacent cutting edges and the shank portions, numerous modifications have been made in the design of adjacent cutting edges for providing severed edges of different shapes, for example pinking shears and curved surgical scissors provide shaped severed edges. Also, the typical pointed edges of conventional scissors are frequently intentionally blunted to reduce the possibilities of actual puncturing of either the fabric or the user and to make it more difficult to utilize these scissors for other tasks which they are not well-designed to perform. This this attempt to improve the safety of operation by reducing the temptation to use the instrument as an awl has limited the usefulness of the scissors for tasks incident to sewing since blunt ends prevent selectively raising and severing individual threads in the fabrics being tailored.

Several designs for multi-purpose scissors have incorporated can opener extensions, screw driver ends and saw blades on the cutting edges or as part of the shank portion of the scissors. Other designs have altered the hand-grippable portions to serve as bottle openers and wrenches. All of these changes have resulted in a departure from the use of the scissors as an implement intended to aid in working with woven fabric and thread. This has resulted in a corresponding decrease in utility for the tailor seeking to practice the sewing arts.

One attempt to adapt conventional scissors to facilitate the tailoring trade is the provision of an elevated region proximate to the end of the scissors so that the user may readily grasp the ends of the device and execute thread pulling operations. To aid in thread pulling, the cutting edges of this type of scissors are terminated well before the ends of the blades to prevent severing of the thread being pulled and a frustration of the intended purpose of the device. This design has been found to limit the ability of the sewing implement to carry out seam-ripping as well as the isolation and severing of individual threads in the fabric being tailored.

Accordingly, an object of the present invention is the provision of a multi-function sewing implement which facilitates the performance of customary tailoring operations. In particular, the present invention provides improved seam-ripping and access to individual threads in a woven fabric without unduly hampering the ability of this device to perform conventional fabric severing operations.

SUMMARY OF THE INVENTION

A multi-function sewing implement constructed in accordance with the present invention includes first and second elongated members which are rotationally secured to each other intermediate their end portions. The first elongated member has a curved first end portion and a hand-grippable opposing end portion. The curved first end portion contains a cutting edge thereon.

The second elongated member has a second end portion and a hand-grippable opposing end portion with a second cutting edge formed on the second member adjacent the first cutting edge. In addition, extension means are affixed to the second end portion and extend outwardly therefrom. A slot means is formed in the extension means and contains at least one sharpened edge in the slot for severing threads.

The extension means extends beyond the end of the first elongated member and includes a protrusion formed on one side of the slot means for placement against and movement along a fabric surface. In preferred embodiments of the invention, the first cutting edge portion extends inwardly of the first end along the shank toward the opposing end of the elongated member. A corresponding adjacently-positioned cutting edge is formed on the shank of the second elongated member to cooperate in the severing of fabric. The curved first end portion enables the user to elevate and isolate individual threads while the slotted extension means permits seam-ripping operations to be performed with the implement.

Further features and advantages of the invention will become more readily apparent from the following detailed description of a specific embodiment of the invention when taken in conjunction with the accompanying drawings.

BRIEF DESCRIPTION OF THE DRAWINGS

FIG. 1 is a side view of a preferred embodiment of the invention.

FIG. 2 is a top view of the embodiment of FIG. 1.

FIG. 3 is an expanded view of the operating edge portions of the embodiment of FIG. 1.

FIG. 4 is a view in cross-section taken along line 4—4 of FIG. 3.

FIG. 5 is a view in cross-section taken along line 5—5 of FIG. 3.

FIG. 6 is a view in cross-section taken along line 6—6 of FIG. 3.

FIG. 7 is a partial side view of the embodiment of FIG. 1 showing the first and second end portions in a closed position.

DESCRIPTION OF THE PREFERRED EMBODIMENT

Referring now to FIG. 1, the multi-function sewing implement which is the subject invention is shown including a first elongated member 11, including a curved first end portion 15, a hand-grippable opposing end portion 13 and shank therebetween. A second elongated member 12 is shown including a second end portion 16 with an opposing end portion having a grippable eyelet 14 with a shank therebetween. The first and second elongated members are rotationally secured one to another by rivet 18 inserted through mating holes in the adjacently positioned shanks of the elongated members. Thus, movement of the hand-grippable portions toward one another result in a closure of the end portions thereof. As noted in FIG. 1, the end portions are shown in an open position to emphasize the configuration of the opposing first and second end portions. The top view of FIG. 2 shows the adjacently positioned end portions in the closed position with extension 17 extending outwardly from the second end portion 16.

The placement and interaction of the various cutting edges and constructional features of the invention can be noted from FIG. 3 wherein the curved first end portion 15 is shown having a first cutting edge 25 extending from tip 26 to the raised end portion at the end of the curve. A cutting edge extension 24 is shown located on the shank and extending toward the rivet 18 from the end of the curved cutting edge 25. The second elongated member 12 is provided with a cutting edge 27 that is spaced adjacent the curved cutting edge 25 and interacts therewith. Cutting edge 27 is shown in this embodiment as being provided with a longitudinal cutting edge extension 28 extending along the shank toward the rivet 18. Cutting edges 24 and 28 interact to provide conventional fabric severing operations.

The extension means 17 affixed to the end of the elongated member 12 contains a slot 22 facing outwardly from the rivet 18. The slot includes a cutting edge 23 extending along the exposed surface thereof. As shown, the slot is located in an off-center position with respect to the extension 17 and includes a curved protrusion extending beyong the cutting edge of the slot and terminating in a rounded tip 21. The outer surface 30 of the protruson of extension 17 is shown flat, for reasons which will later be discussed, and extends rearwardly toward the pivot 18 on the shank. At the point where the extension 17 is affixed to the shank of elongated member 16, the elongated member is shown tapered inwardly providing a narrowed cross-section so that the protrusion can be placed on contact with and moved along a fabric surface or, alternatively, the protrusion mmay be inserted between stitchings defining a buttonhole and used to sever the fabric therebetween.

The orientation of the cutting edges 25 and 27 in the dashed outline of FIG. 3 show the first elongated member 11 rotated to a more fully open position for performing operations which involve this member's tip 26 and adjacent cutting edge 25. In this position, the tip 26 is available for use in isolating a single thread or a grouping such as found with a button. The combination of a curved tip and a sharpened edge cause the thread to elevate from the fabric while being servered. In addition, the blunted tip 26 essentially eliminates the unintentional severing of adjacent fabric.

The sewing implement is shown in FIG. 7 with the hand-grippable portions moved in mutual contact to close the end portions 15 and 16 so that they are mutually adjacent. The extension of the second end portion 16 is to be noted as including the protrusion ending with tip 21 along the outer edge thereof. Outer edge 30 is generally a flat surface to permit it to be moved easily along a fabric work surface. The bottom portion of extension 17 contains the slot 22 with the cutting edge 23 extending thereabout. The lower edge of extension 17 is made shorter so that when the protrusion is inserted between stitchings to sever fabric, the user can view the cutting action as it takes place. This operation occurs when the implement is rotated from the position shown in the figures. The cross-sectional view in FIG. 6 taken along line 6—6 of FIG. 3, shows that the preferred embodiment is provided with cutting edges 23 on each side of the slot 22.

The preferred embodiment of the invention provides the tailor with the ability to perform several necessary functions with a single device. The curved end portion 15 is designed to permit the user to readily isolate and elevate a particular thread, either one that has been sewn there or one that is part of the integral fabric, without disturbing adjacent threads. The curved cutting edge, in combination with the blunted tip 26, permit the tip to be initially inserted under the thread while minimizing the possibility of accidental servering of nearby threads. The closure of the adjacent end portions by movement of the hand-grippable portions 13 and 14 result in a severing of that thread.

Behind the curved end portion and located on the shank of the first elongated member 11 is a generally straight cutting edge which is utilized in combination with the corresponding cutting edge on the second elongated member to permit the normal severing operation of fabric. The rotation of the implement 180 degrees from the position shown enables the user to place the outer edge 30 against a fabric or an underlying support surface and utilize the rounded tip 21 to extend through a fabric and after rotation, be moved beneath the surface of a seam. The seam threads then being guided along the protrusion into slot 22 for severing at the cutting edge 23. Thus, a number of different tasks can be provided by this multi-function sewing implement without requiring the user to set one tool down and replace it with another. Since a fabric worker is frequently dealing with material that is gathered, the use of a number of different implements becomes difficult and unwieldy.

While the foregoig description has referred to a specific embodiment of the invention, it is to be noted that many variations and modifications may be made therein without departing from the scope of the invention as claimed.

What is claimed is:

1. A multifunction sewing implement which comprises:

(a) a first elongated member having a curved first end portion and a hand-grippable opposing end portion;

(b) a second elongated member having a second end portion and a hand-grippable opposing end portion;

(c) means for rotationally securing said first and second members intermediate the end portions thereof;

(d) a first cutting edge formed on said curved first end portion;

(e) a second cutting edge formed on the second elongated member adjacent said first cutting edge;

(f) extension means affixed to said second end portion and extending outwardly therefrom beyond the end of the first end portion of the first elongated member; and (g) slot means formed in said extension means and having at least one sharpened edge therein for severing thread, said slot means including a protrusion formed on one side thereof for movement along a fabric surface located on the side of said slot means remote from the first end portion of said first member.

2. The invention of claim 1 wherein said protrusion has a rounded end, said protrusion extending longitudinally outward from said slot means.

3. The invention of claim 2 wherein said protrusion has an outer edge parallel to the adjacent edge of the slot means.

4. The invention of claim 3 wherein the second end portion of the second elongated member is tapered inwardly from the extension means to permit the outer edge thereof to contact the surface of a workpiece.

* * * * *